US011388949B2

(12) United States Patent
Verfl et al.

(10) Patent No.: US 11,388,949 B2
(45) Date of Patent: Jul. 19, 2022

(54) SHOE HAVING A CONCAVE OUTSOLE

(71) Applicant: Cole Haan LLC, New York, NY (US)

(72) Inventors: Mattias Verfl, Greenland, NH (US); Jeffrey Mokos, Greenland, NH (US)

(73) Assignee: COLE HAAN LLC, Greenland, NH (US)

( * ) Notice: Subject to any disclaimer, the term of this patent is extended or adjusted under 35 U.S.C. 154(b) by 299 days.

(21) Appl. No.: 16/208,190

(22) Filed: Dec. 3, 2018

(65) Prior Publication Data

US 2020/0170339 A1 Jun. 4, 2020

(51) Int. Cl.
*A43B 13/14* (2006.01)
*A43B 13/22* (2006.01)

(52) U.S. Cl.
CPC ..... *A43B 13/146* (2013.01); *A43B 13/223* (2013.01)

(58) Field of Classification Search
CPC ..... A43B 13/223; A43B 13/146
USPC ..... 36/25 R
See application file for complete search history.

(56) References Cited

U.S. PATENT DOCUMENTS 4,259,792 A 4/1981 Halberstadt
4,335,530 A 6/1982 Stubblefield
4,372,058 A 2/1983 Stubblefield
4,389,798 A 6/1983 Tiles
4,449,307 A 5/1984 Stubblefield
4,481,727 A 11/1984 Stubblefield
4,494,320 A 1/1985 Davis
4,546,556 A 10/1985 Stubblefield
4,550,510 A 11/1985 Stubblefield
4,741,114 A * 5/1988 Stubblefield ..... A43B 13/146 36/114
4,785,557 A 11/1988 Kelley et al.
RE33,066 E 9/1989 Stubblefield
5,185,943 A 2/1993 Tong et al.
5,625,963 A 5/1997 Miller et al.
5,628,128 A 5/1997 Miller et al.
6,470,599 B1 10/2002 Chu
7,814,686 B2 10/2010 Becker et al.
8,125,796 B2 2/2012 Ellis
8,863,407 B2 * 10/2014 Nishiwaki ..... A43B 5/06 36/27
9,974,356 B2 * 5/2018 Foxen ..... A43B 5/00
2004/0069389 A1 4/2004 Ratliff
2011/0209295 A1 * 9/2011 Sokolowski ..... A43B 13/187 12/142 R
2013/0019505 A1 1/2013 Borel et al.
(Continued)

*Primary Examiner* — Khoa D Huynh
*Assistant Examiner* — Uyen T Nguyen
(74) *Attorney, Agent, or Firm* — Thompson Coburn LLP

(57) ABSTRACT

A shoe includes an outsole having a heel region, a midfoot region, a metatarsal region, and a toe region. The heel region extends longitudinally from the heel end to the midfoot region, the midfoot region extends longitudinally from the heel region to the metatarsal region, and the toe region extends longitudinally from the toe end to the metatarsal region. The outsole has a medial side region, central region, and a lateral side region. A bottom surface of the outsole defines a concavity extending longitudinally from within the heel region to at least within a portion of the midfoot region. The concavity extends laterally within the central region. The concavity has a width at its widest point that is at least between 45% and 55% the width of the outsole at that point.

20 Claims, 9 Drawing Sheets

(56) References Cited

U.S. PATENT DOCUMENTS

| | | | | |
|---|---|---|---|---|
| 2015/0101215 | A1* | 4/2015 | Henderson | A43B 3/0057<br>36/103 |
| 2015/0359294 | A1* | 12/2015 | VanHook | A43B 13/223<br>36/25 R |
| 2018/0132563 | A1* | 5/2018 | Hillyer | A43B 13/125 |
| 2019/0053571 | A1* | 2/2019 | Bjornson | A43B 7/1445 |
| 2019/0069630 | A1* | 3/2019 | Hopkins | A43C 15/162 |

* cited by examiner

SHOE HAVING A CONCAVE OUTSOLE

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND

Field

This disclosure pertains to shoe outsoles.

SUMMARY

One aspect of the disclosure pertains to a shoe including an outsole extending from a heel end to a toe end and from a medial side to a lateral side. The outsole has a heel region, a midfoot region, a metatarsal region, and a toe region. The heel region extends longitudinally from the heel end to the midfoot region, the midfoot region extends longitudinally from the heel region to the metatarsal region, and the toe region extends longitudinally from the toe end to the metatarsal region. The outsole has a medial side region, central region, and a lateral side region. The medial side region extends transversely from the medial side to the central region. The lateral side region extends transversely from the lateral side to the central region, and the central region extends transversely between the lateral side region and the medial side region. The outsole has a bottom surface and a top surface. The bottom surface of the outsole defines a concavity extending longitudinally from within the heel region to at least within a portion of the midfoot region. The concavity extends laterally within the central region. The concavity has a width at its widest point that is at least between 45% and 55% the width of the outsole at that point.

Another aspect of the disclosure pertains to a shoe including an outsole extending from a heel end to a toe end and from a medial side to a lateral side. The outsole has a heel region, a midfoot region, a metatarsal region, and a toe region. The heel region extends from the heel end toward the midfoot region, the midfoot region extends from the heel region toward the metatarsal region, and the toe region extends from the toe end toward the metatarsal region. The outsole has a medial side region, central region, and a lateral side region. The medial side region extends from the medial side toward the central region, the lateral side region extends from the lateral side toward the central region, and the central region extends between the lateral side region and the medial side region. The outsole has a bottom surface and a top surface. The bottom surface of the outsole includes a portion being contoured to form a depression relative to a remainder of the bottom surface. The depression is within the central region and the midfoot region. The depression has a width at its widest point that is at least between 45% and 55% the width of the outsole at that point.

A still further aspect of the disclosure pertains to a shoe including an outsole extending from a heel end to a toe end and from a medial side to a lateral side. The outsole has a heel region, a midfoot region, a metatarsal region, and a toe region. The heel region extends from the heel end toward the midfoot region, the midfoot region extends from the heel region toward the metatarsal region, and the toe region extends from the toe end toward the metatarsal region. The outsole has a medial side region, central region, and a lateral side region. The medial side region extends from the medial side toward the central region, the lateral side region extends from the lateral side toward the central region, and the central region extends between the lateral side region and the medial side region. The outsole has a bottom surface and a top surface. The bottom surface extends upward from the medial side region and into the central region to partially define a depression. The bottom surface extends upward from the lateral side region and into the central region to further partially define the depression. The bottom surface extends upward from the metatarsal region into the midfoot region to further partially define the depression, the bottom surface extends upward from the heel region into the midfoot region to further partially define the depression.

Further features and advantages of the present disclosure, as well as the operation of the embodiments described herein, are described in detail below with reference to the accompanying drawings.

Figure 1:
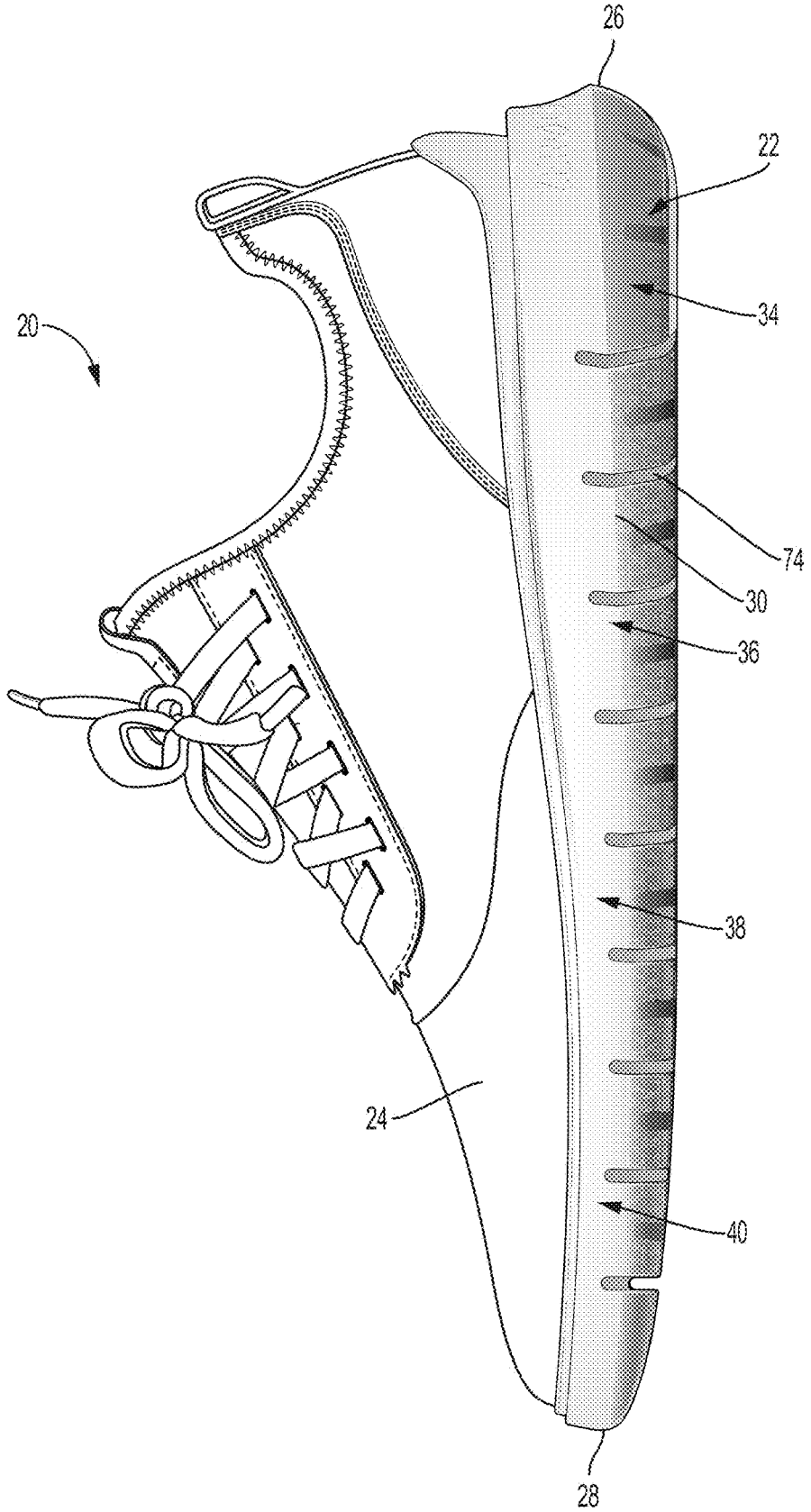
FIG. 1 is a medial side view of an embodiment of a shoe, the shoe including an outsole with a concave depression extending upward into the outsole.
Figure 2:
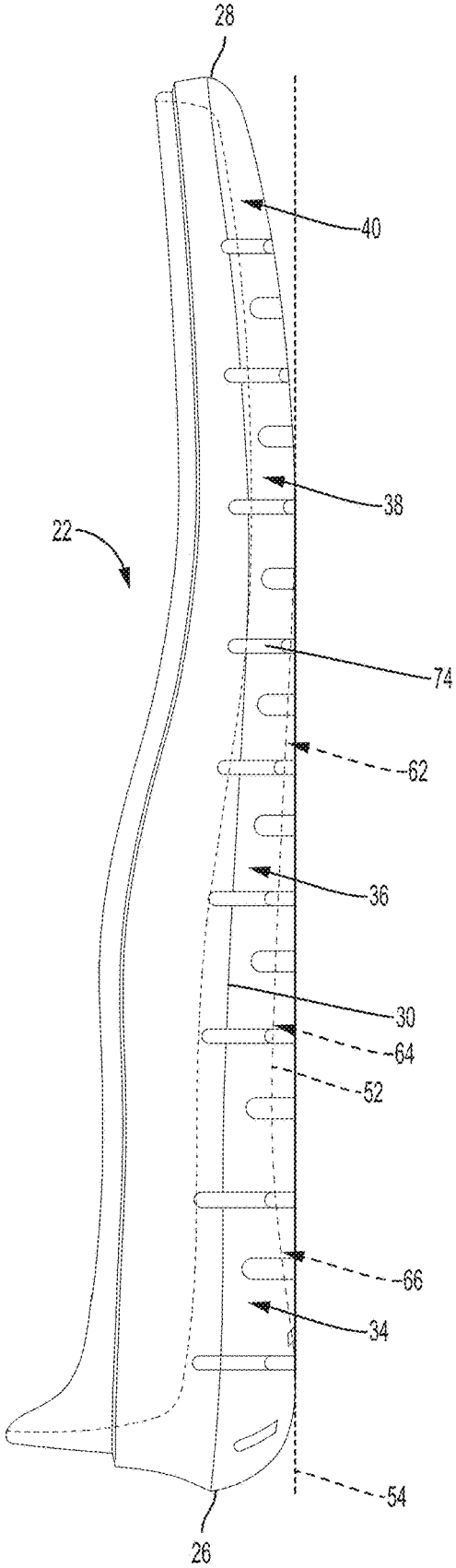
FIG. 2 is a medial side view of the outsole shown in FIG. 1.
Figure 3:
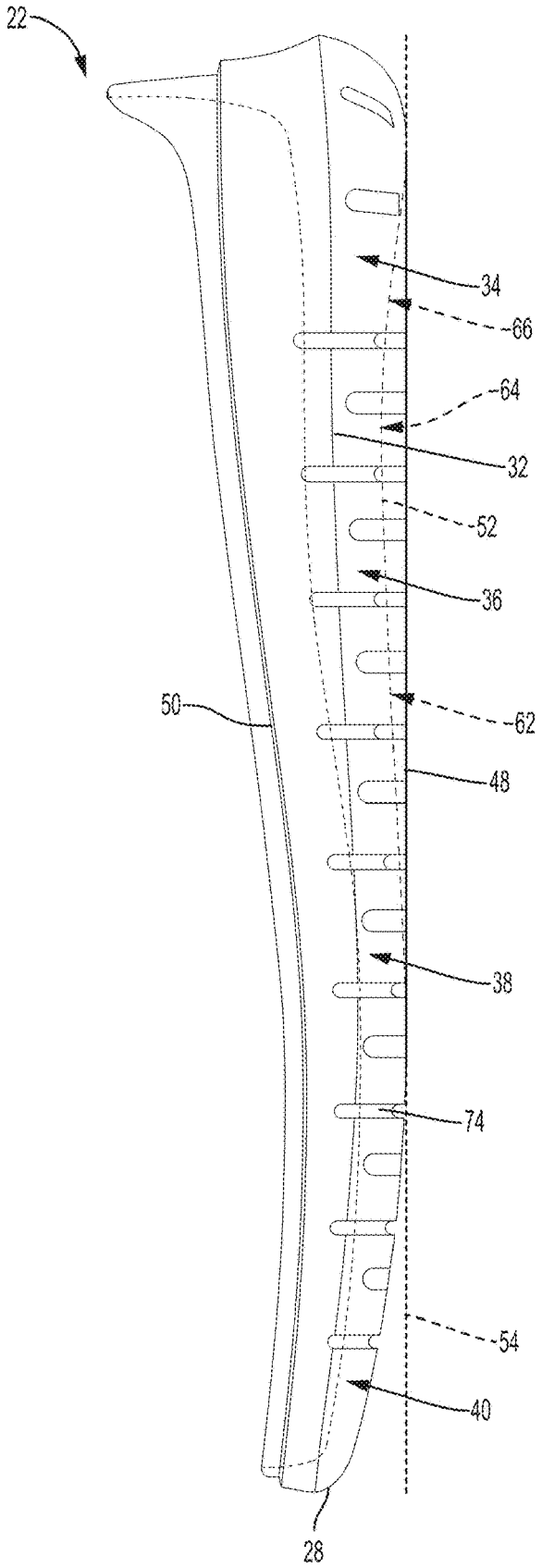
FIG. 3 is a lateral side view of the outsole shown in FIG. 1.
Figure 4:
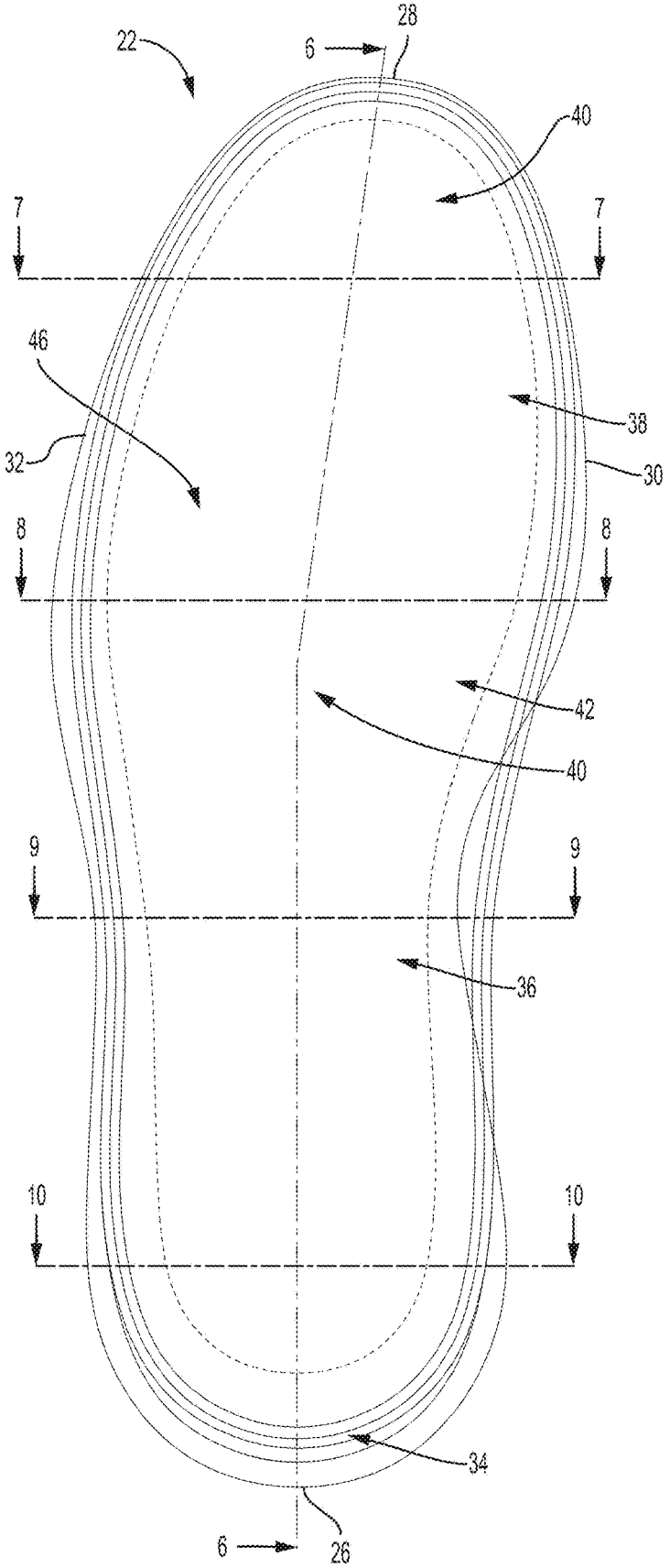
FIG. 4 is a top view of the outsole shown in FIG. 1.
Figure 5:
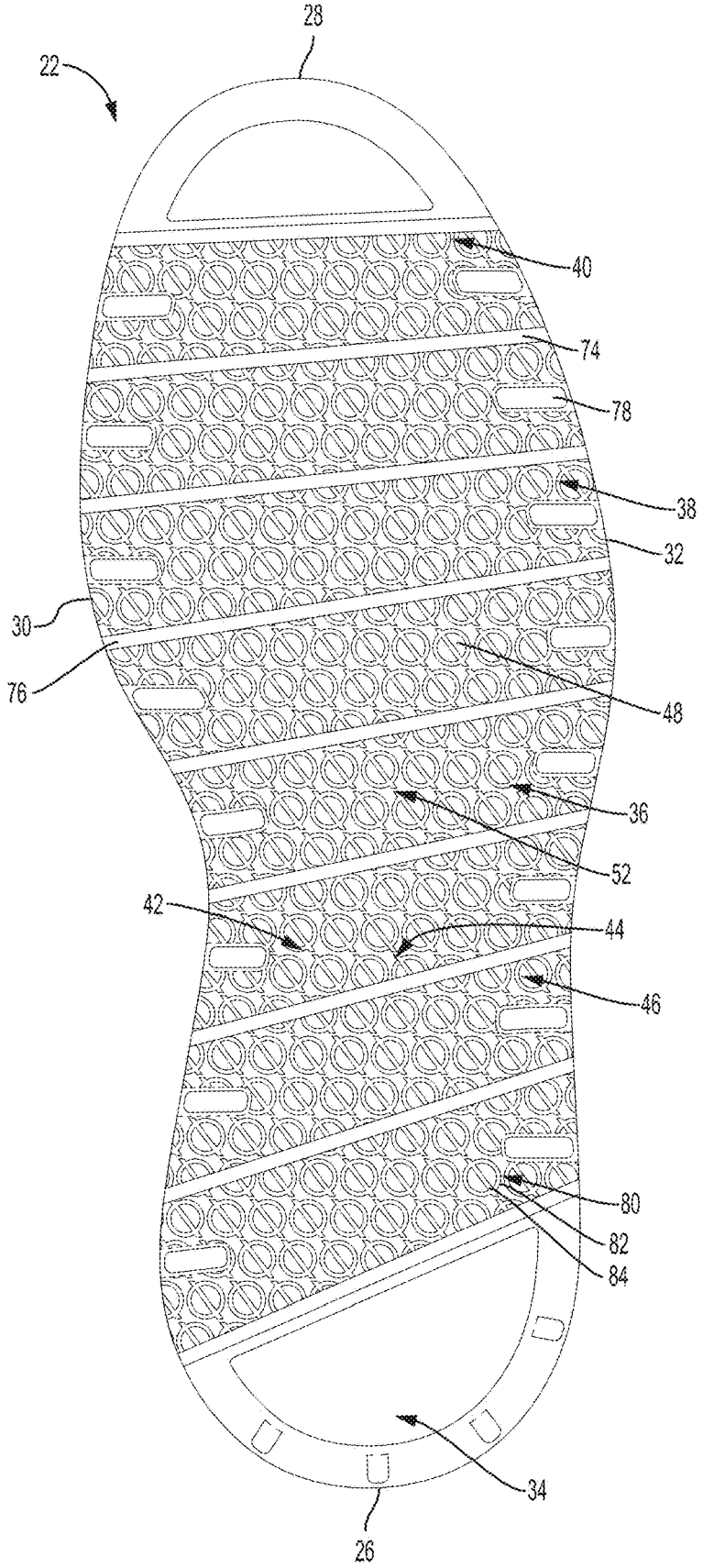
FIG. 5 is a bottom view of the outsole shown in FIG. 1.
Figure 6:
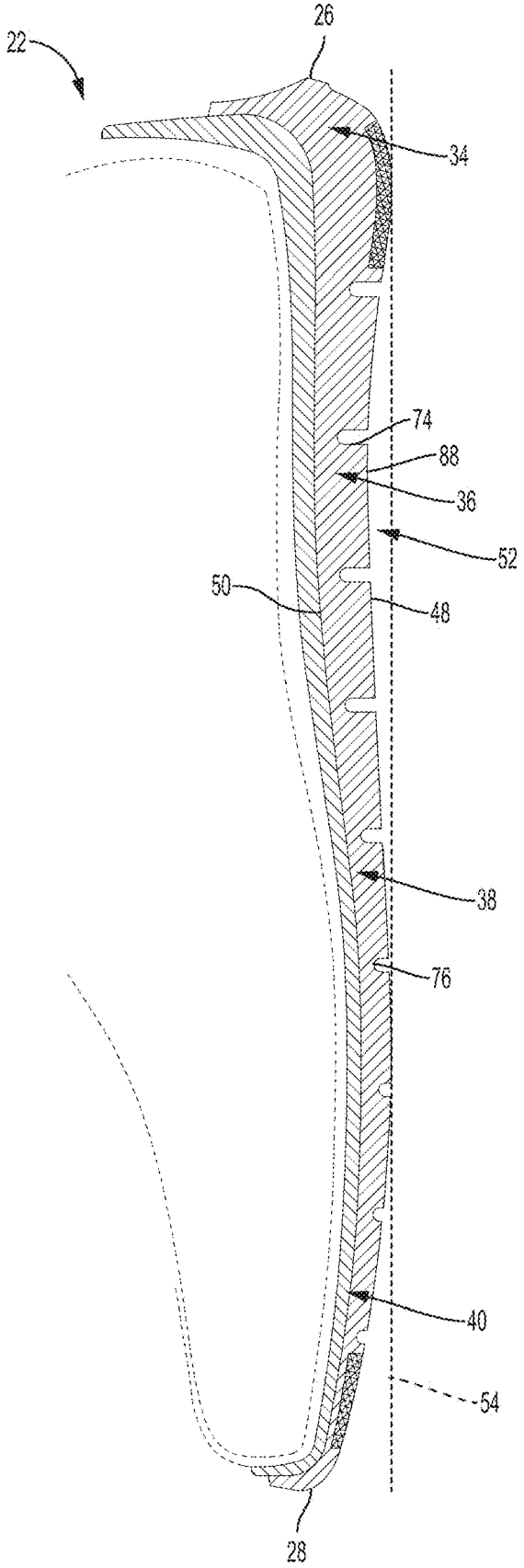
FIG. 6 is a cross-sectional view taken along the line 6-6.
Figure 7:
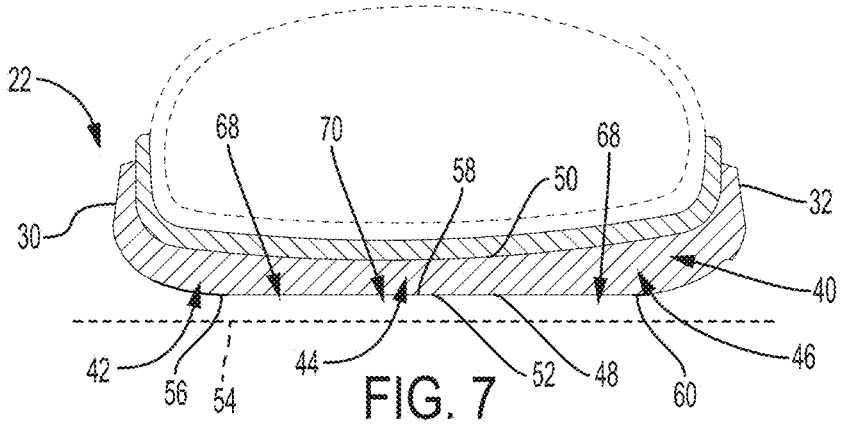
FIG. 7 is a cross-sectional view taken along the line 7-7.
Figure 8:
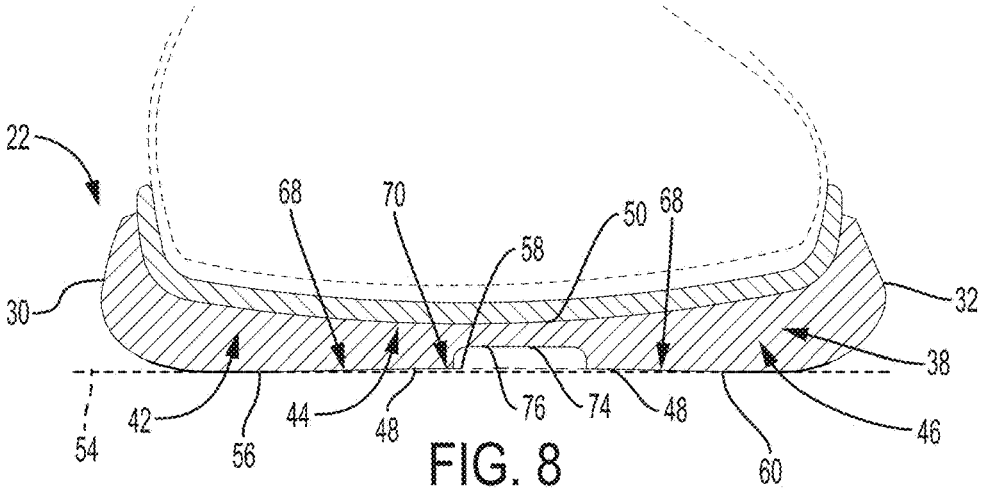
FIG. 8 is a cross-sectional view taken along the line 8-8.
Figure 9:
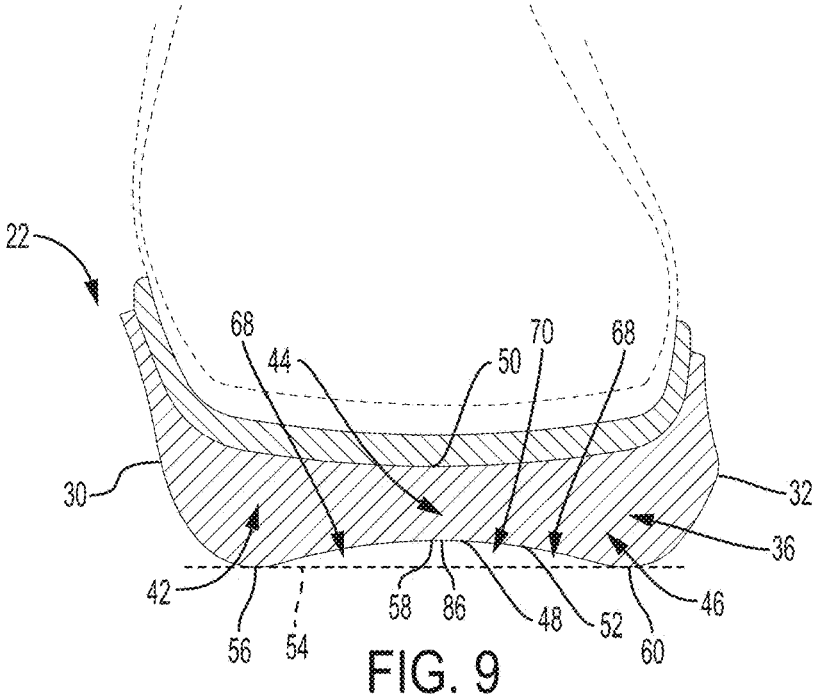
FIG. 9 is a cross-sectional view taken along the line 9-9.
Figure 10:
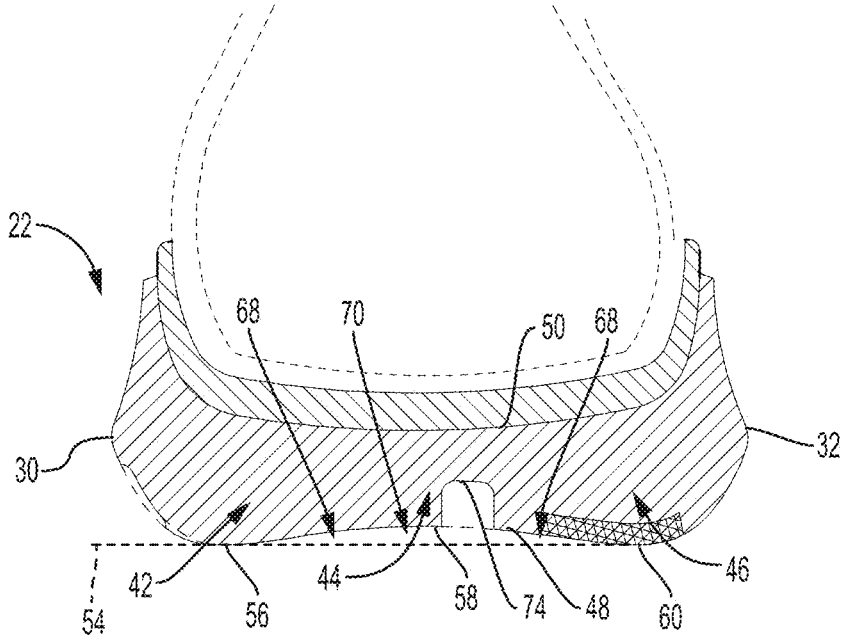
FIG. 10 is a cross-sectional view taken along the line 10-10.
Figure 11:
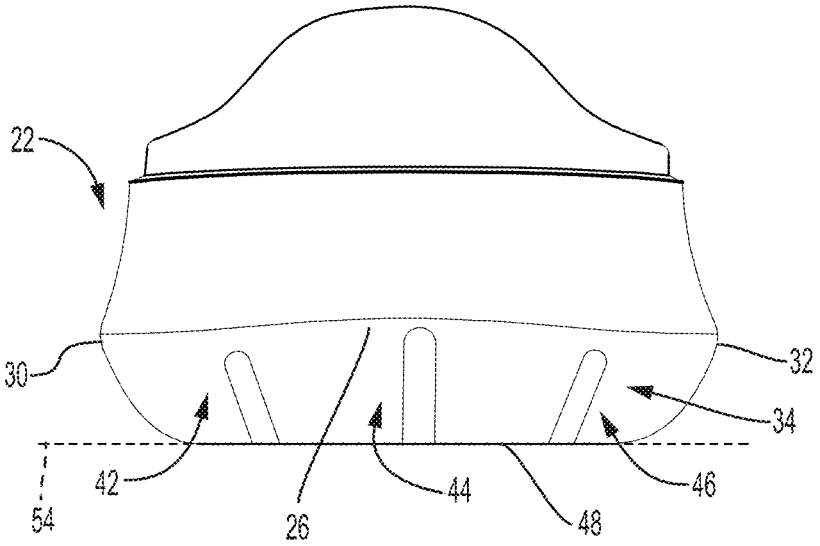
FIG. 11 is a rear view of the outsole shown in FIG. 1.
Figure 12:
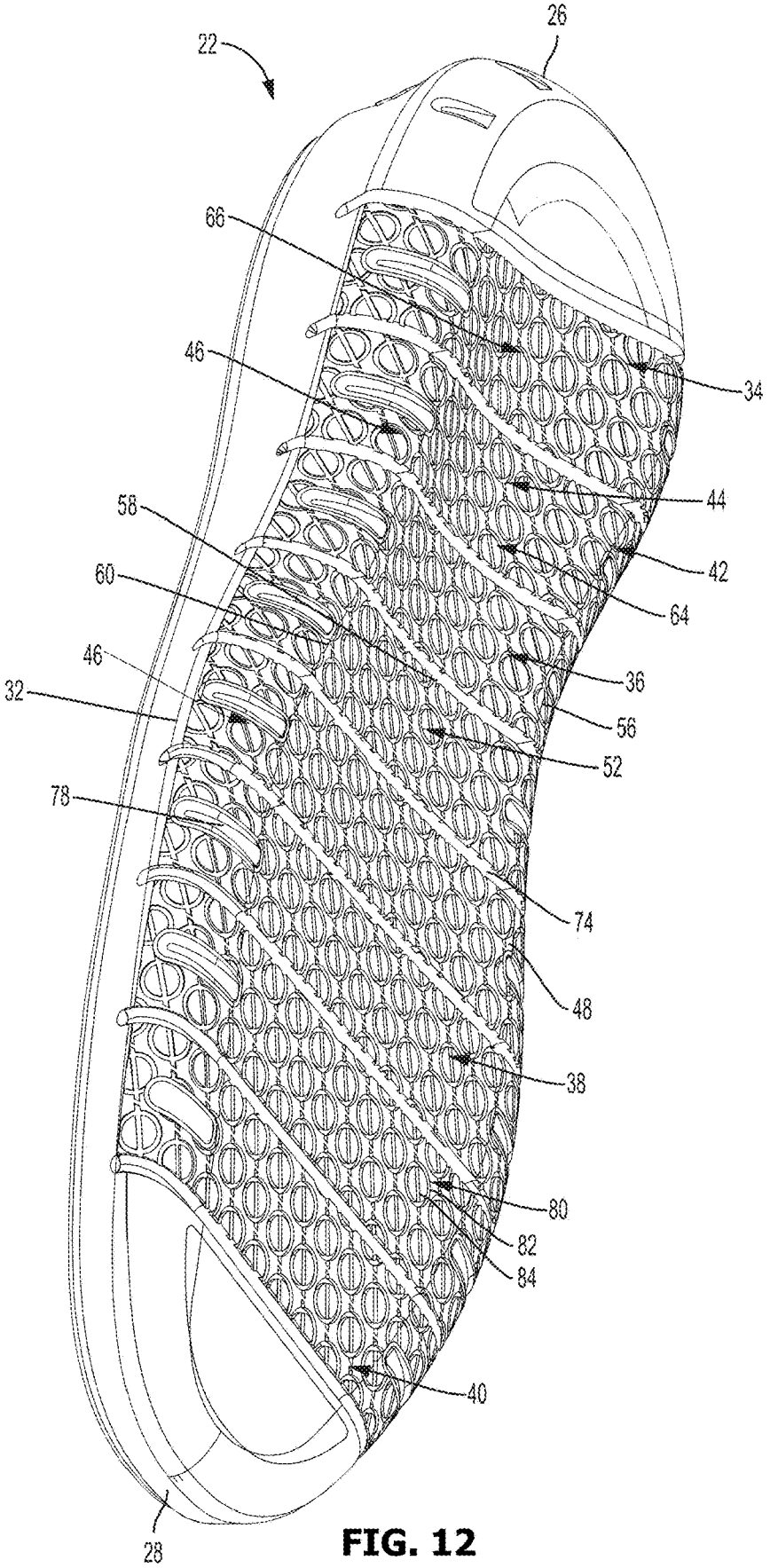
FIG. 12 is a bottom perspective view of the outsole shown in FIG. 1.

Reference numerals in the written specification and in the drawing figures indicate corresponding items.

DETAILED DESCRIPTION

An embodiment of a shoe 20 having an outsole 22 is depicted in FIG. 1. The shoe 20 includes the outsole 22 and an upper 24 coupled to the outsole 22. The outsole 22 is depicted in greater detail in FIGS. 1-12. It should be understood that a variety of different uppers 24 may be coupled to the outsole 22, and the upper 24 is not restricted to the upper 24 depicted in FIG. 1. The outsole 22 is adapted and configured to provide a rebound effect. Generally, the outsole 22 has a scooped-out configuration such that a central channel is provided and the outsole functions in like manner to that of a leaf spring. The central channel is not a sipe or groove, but in contrast is significantly wider. This configuration provides increased comfort and cushioning. This configuration may also provide a spring-like absorption of impact, dampening of impact, and a restorative force.

The outsole 22 extends from a heel end 26 to a toe end 28 and from a medial side 30 to a lateral side 32. As used herein, the term end with respect to the medial and lateral sides indicates the end and/or the side wall of the outsole unless stated otherwise. The outsole 22 includes a heel region 34, a midfoot region 36, a metatarsal region 38, and a toe region 40. The heel region 34 extends from the heel end 26 toward the midfoot region 36. The midfoot region 36 extends from the heel region 34 toward the metatarsal region 38. The toe region 40 extends from the toe end 28 toward the metatarsal region 38. The outsole 22 has a medial side region 42, a central region 44, and a lateral side region 46. As used herein with respect to the medial side and the lateral side, the term region refers to a margin or area as opposed to the term end. The medial side region 42 extends from the medial side 30 toward the central region 44. The lateral side region 46 extends from the lateral side 32 toward the central region 44. The central region 44 extends between the lateral side region 46 and the medial side region 42. The central region 44 extends laterally between the lateral side region and the medial side region for a substantial distance. For example and without limitation, the central region 44 has a width greater than a sipe, groove, or other feature inset into the outsole 22. The outsole 22 has a bottom surface 48 and a top surface 50. The bottom surface 48 of the outsole 22 defines a concavity 52 extending longitudinally from within the heel region 34 to at least within a portion of the midfoot region 36. The concavity 52 extends laterally within the central region 44. The concavity 52 creates a space between the bottom surface 48 of the outsole 22 and a ground surface 54 when the shoe 20 is not under load. When the shoe 20 is under load (e.g., the weight of a wearer or the weight of a downward step), the space is diminished.

The concavity 52 is defined at least partially by three inflection points about which the bottom surface curves 48 as it extends laterally. The bottom surface 48 curves upward at a first inflection point 56 towards a second inflection point 58 after which the bottom surface 48 curves downward to a third inflection point 60. The concavity 52 has a forward portion 62, a central portion 64, and a rearward portion 66. The forward portion 62 is nearer the toe end 28 than the central portion 64, and the rearward portion 66 is nearer the heel end 26 than the central portion 64. The central portion 64 of the concavity 52 has a greater depth than the forward portion 62 and the rearward portion 66. The concavity 52 further includes a medial portion 68, a central portion 70, and a lateral portion 72. The medial portion 68 is nearer the medial side 30 than the central portion 70, and the lateral portion 72 is nearer the lateral side 32 than the central portion 70. The central portion 70 of the concavity has a greater depth than the medial portion 68 and the lateral portion 72.

In some embodiments, at least a portion of the heel region 34 is substantially flat and devoid of the concavity 52. For example and without limitation, a heelward portion of heel region 34 is substantially flat in that the concavity 52 does not extend into that portion. Alternatively, the concavity may extend through the entirety of the heel region 34. In some embodiments, a portion of the metatarsal region 38 is substantially flat and devoid of the concavity. For example and without limitation, the concavity 52 does not extend into a toeward portion of the metatarsal region 38.

Forward of the concavity 52, the bottom surface 48 slopes upward from the metatarsal region 38, slopes upward within the toe region 40, and slopes upward to the toe end 28. Laterally outside the concavity 52, the bottom surface 48 curves upward within the lateral side region 46 toward the lateral side 32, and the bottom surface curves upward within the medial side region 42 toward the medial side 30.

In some embodiments, such as the depicted embodiment, the outsole has a plurality of sipes 74 extending laterally across the outsole 22. Each of the plurality of sipes 74 extends upward and into the bottom surface of the outsole 22. At least one of the plurality of sipes extends through the concavity 52. For example and without limitation, the sipe 76 extends through the portion of the outsole 22 that defines the concavity 52. The sipes (e.g., sipe 76) extending through the concavity 52 maintain a constant depth relative to the bottom surface 48 regardless of the slope or depth of the concavity and/or the position within the concavity (e.g., the forward portion 62, central portion 64, or rearward portion 66). In alternative embodiments, the sipes do not maintain a constant depth relative to the bottom surface 48. For example and without limitation, the sipes may get shallower as the concavity 52 increases in depth (e.g., relative to the ground surface 54).

The sipes 74 extend from the lateral side 32 to the medial side 30. The sipes 74 extend entirely across the outsole 22 as can best be seen in FIG. 5. The plurality of sipes 74 extend diagonally across the outsole 22. In alternative embodiments, the plurality of sipes 74 may have alternative orientations, numbers, depths, may vary, and/or may otherwise differ from the sipes 74 depicted. Advantageously, the sipes 74 provide increased flexibility and/or traction. This advantage is enhanced by the consistent depth of the sipes 74 as the sipes pass through the portion of the outsole 22 defining the concavity 52.

The outsole 22 further includes a plurality of substantially rectangular indentations 78 extending upward from the bottom surface 48. The plurality of substantially rectangular indentations 78 alternate with the plurality of sipes longitudinally along the length of the outsole 22. The plurality of substantially rectangular indentations 78 are positioned within the medial side region 42 and the lateral side region 46. In some embodiments, at least some of the plurality of substantially rectangular indentations 78 extend upward from a portion of the outsole defining the concavity 52. The outsole 22 includes a traction pattern comprising a repeating series of substantially similar traction units 80. Each traction unit 80 comprising a circular channel 82 bisected by a diagonal channel 84. The diagonal channel 84 has a length greater than the diameter of the circular channel 82. The circular channel 84 and the diagonal channel 84 both extend upwards from the bottom surface 48.

Still referring to FIGS. 1-12, the concavity 52 need not be entirely concave and may have a variety of configurations in alternative embodiments. In all embodiments, the outsole 20 is shaped to provide the channel or concavity 52 of the type described herein. In other words, the bottom surface 48 of the outsole 22 includes a portion being contoured to form a depression relative to a remainder of the bottom surface. The depression is within the central region 44 and the midfoot region 36. The depression is substantially arch shaped in transverse cross-section and extends from the medial side region 42 to the lateral side region 46. An apex 86 of the arch shape of the depression is within the central region 44. For example and without limitation, the apex 86 is on the longitudinal axis of the outsole 22. In alternative embodiments, the apex 86 may be biased toward either the lateral side 32 or the medial side 30. The bias may be uniform along the longitudinal length of the concavity 52. Alternatively, the bias may vary along the longitudinal length of the concavity 52. For example and without limitation, the bias of the apex 86 may increase in bias toward either side moving toward the heel end 26. In one embodiment, the apex 86 is biased toward the medial side 30 a first amount in the midfoot region and a second amount in the heel region; the second amount being greater than the first amount.

The depression formed by the outsole 22 is substantially curved shaped in longitudinal cross-section and extends from the metatarsal region 38 to the heel region 34. The curved shape has an inflection point 88 positioned within the midfoot region 36. The inflection point 88 is nearer a heel side end of the depression than a toe side end of the depression. In alternative embodiments, the inflection point 88 is positioned elsewhere. For example and without limitation, the inflection point 88 is centered within the midfoot region, biased toward the toe end of the midfoot region, positioned in the heel region, or positioned within the metatarsal region. The depression is asymmetrical in a longitudinal direction. In alternative embodiments, the depression is symmetrical in the longitudinal direction.

The channel formed by the outsole 22 need not be curved or smoothly transition as previously described herein. For example and without limitation, the concavity 52 may be substantially rectangular in longitudinal cross-section and/or transverse cross-section. The concavity 52 may alternatively be a mixture of curves and straight edges in different portions. In most embodiments, the bottom surface 48 extends upward from the medial side region 42 and into the central region 44 to partially define a depression. The bottom surface 48 extends upward from the lateral side region 46 and into the central region 44 to further partially define the depression. In some embodiments, the bottom surface 48 also extends upward from the metatarsal region 38 into the midfoot region 36 to further partially define the depression. The bottom surface 48 extends upward from the heel region 34 into the midfoot region 36 to further partially define the depression. In alternative embodiments, the depression extends into the metatarsal region, the toe region, and/or the heel region. The bottom surface 48 extending about the depression forms a semi-elliptical spring adapted and configured to flex under load and apply a restorative force in an upward direction. The width of the depression varies longitudinally along the outsole 22.

In all embodiments, the concavity 52, depression, channel, or the like differs from a groove or sipe. Rather than providing flexibility or traction as a typical groove or sipe, the channel feature provides the flex and/or restorative force described herein and/or otherwise increases the comfort of the wearer. As such, the channel is wider than a groove or sipe. For example and without limitation, the channel has a width at its widest point that is at least between 20% and 30% the width of the outsole 22 at that point. More preferably, the channel has a width at its widest point that is at least between 30% and 50% the width of the outsole 22 at that point. Still more preferably, the channel has a width at its widest point that is at least between 50% and 80% the width of the outsole 22 at that point. In some embodiments, the channel has a width as described above not only at the widest point but for at least between 20% and 30% of the longitudinal length of the outsole 22. More preferably, the above described widths extend for at least between 30% and 50% of the longitudinal length of the outsole 22.

In view of the foregoing, it should be appreciated that the shoe of the disclosure has several advantages over the prior art.

As various modifications could be made in the constructions and methods herein described and illustrated without departing from the scope of the disclosure, it is intended that all matter contained in the foregoing description or shown in the accompanying drawings shall be interpreted as illustrative rather than limiting. For example, the wedge shoe may be any type of wedge shoe, such as a wedge sandal, a wedge pump, an open-toe wedge, a platform wedge, etc. Thus, the breadth and scope of the present disclosure should not be limited by any of the above-described exemplary embodiments, but should be defined only in accordance with the following claims appended hereto and their equivalents.

It should also be understood that when introducing elements in the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising an outsole extending from a heel end to a toe end and from a medial side to a lateral side, the outsole having a heel region, a midfoot region, a metatarsal region, and a toe region, the heel region extending longitudinally from the heel end to the midfoot region, the midfoot region extending longitudinally from the heel region to the metatarsal region, the toe region extending longitudinally from the toe end to the metatarsal region, the outsole having a medial side region, a central region, and a lateral side region, the medial side region extending transversely from the medial side to the central region, the lateral side region extending transversely from the lateral side to the central region, the central region extending transversely from the lateral side region to the medial side region, the outsole having a bottom surface and a top surface, the bottom surface of the outsole defining a concavity extending longitudinally within the midfoot region and the metatarsal region, the concavity extending transversely within the central region, the concavity having a width at its widest point that is between 45% and 55% the width of the outsole at that point.

2. A shoe in accordance with claim 1, the concavity having a forward portion, a central portion, and a rearward portion, the forward portion being nearer the toe end than the central portion and the rearward portion being nearer the heel end than the central portion, the central portion of the concavity having a greater depth than the forward portion and the rearward portion.

3. A shoe in accordance with claim 1, the concavity having a medial portion, a central portion, and a lateral portion, the medial portion being nearer the medial side than the central portion and the lateral portion being nearer the lateral side than the central portion, the central portion of the concavity having a greater depth than the medial portion and the lateral portion.

4. A shoe in accordance with claim 1, wherein a portion of the heel region is substantially flat and devoid of the concavity.

5. A shoe in accordance with claim 1, wherein a portion of the metatarsal region is substantially flat and devoid of the concavity.

6. A shoe in accordance with claim 1, wherein the bottom surface slopes upward from the metatarsal region, within the toe region, and to the toe end.

7. A shoe in accordance with claim 1, wherein the bottom surface curves upward within the lateral side region toward the lateral side, and wherein the bottom surface curves upward within the medial side region toward the medial side.

8. A shoe in accordance with claim 1, the outsole having a plurality of sipes extending laterally across the outsole, the plurality of sipes extending upward and into the bottom surface of the outsole.

9. A shoe in accordance with claim 8, wherein at least one sipe extends through the concavity.

10. A shoe in accordance with claim 8, wherein the plurality of sipes extend from the lateral side to the medial side.

11. A shoe in accordance with claim 8, wherein the plurality of sipes extend diagonally across the outsole.

12. A shoe in accordance with claim 8, wherein the outsole comprises a plurality of substantially rectangular indentations extending upward from the bottom surface, the plurality of substantially rectangular indentations alternating with the plurality of sipes, the plurality of substantially rectangular indentations being positioned within the medial side region and the lateral side region, and wherein at least some of the plurality of substantially rectangular indentations extend upward from a portion of the outsole defining the concavity.

13. A shoe in accordance with claim 1, wherein the outsole includes a traction pattern, the traction pattern comprising a repeating series of substantially similar traction units, each traction unit comprising a circular channel bisected by a diagonal channel.

14. A shoe comprising an outsole extending longitudinally from a heel end to a toe end and transversely from a medial side to a lateral side, the outsole having a heel region, a midfoot region, a metatarsal region, and a toe region, the heel region extending from the heel end toward the midfoot region, the midfoot region extending from the heel region toward the metatarsal region, the toe region extending from the toe end toward the metatarsal region, the outsole having a medial side region, central region, and a lateral side region, the medial side region extending from the medial side toward the central region, the lateral side region extending from the lateral side toward the central region, the central region extending between the lateral side region and the medial side region, the outsole having a bottom surface and a top surface, the bottom surface of the outsole including a portion being contoured to form a depression relative to a remainder of the bottom surface, the depression being within the central region and the midfoot region, the depression having a width at its widest point that is between 45% and 55% the width of the outsole at that point.

15. A shoe in accordance with claim 14, the depression being substantially arch shaped and extending from the medial side region to the lateral side region, an apex of the arch shape of the depression being within the central region.

16. A shoe in accordance with claim 15, the depression being substantially curved shaped and extending from the metatarsal region to the heel region, the curved shape having an inflection point positioned within the midfoot region.

17. A shoe in accordance with claim 16, wherein the inflection point is nearer a heel side end of the depression than a toe side end of the depression, such that the depression is asymmetrical in a longitudinal direction.

18. A shoe comprising an outsole extending from a heel end to a toe end and from a medial side to a lateral side, the outsole having a heel region, a midfoot region, a metatarsal region, and a toe region, the heel region extending from the heel end toward the midfoot region, the midfoot region extending from the heel region toward the metatarsal region, the toe region extending from the toe end toward the metatarsal region, the outsole having a medial side region, central region, and a lateral side region, the medial side region extending from the medial side toward the central region, the lateral side region extending from the lateral side toward the central region, the central region extending between the lateral side region and the medial side region, the outsole having a bottom surface and a top surface, the bottom surface extending upward from the medial side region and into the central region to partially define a depression, the bottom surface extending upward from the lateral side region and into the central region to further partially define the depression, the depression having a width at its widest point that is between 45% and 55% the width of the outsole at that point, the depression further being defined at least partially by three inflection points about which the bottom surface curves as it extends laterally, the bottom surface extending upward from the metatarsal region into the midfoot region to further partially define the depression, the bottom surface extending upward from the heel region into the midfoot region to further partially define the depression.

19. A shoe in accordance with claim 18, wherein the bottom surface extends about the depression such that the outsole forms a semi-elliptical spring of varying thickness, the semi-elliptical spring being adapted and configured to flex under load and apply a restorative force in an upward direction.

20. A shoe in accordance with claim 18, wherein a width of the depression varies longitudinally along the outsole.

* * * * *